United States Patent [19]

Tanaka et al.

[11] Patent Number: 4,891,831

[45] Date of Patent: Jan. 2, 1990

[54] X-RAY TUBE AND METHOD FOR GENERATING X-RAYS IN THE X-RAY TUBE

[75] Inventors: Akira Tanaka, Katsuta; Satoshi Shimada, Hitachi; Kazuji Yamada, Hitachi; Yusaku Nakagawa, Hitachi; Motohisa Nishihara, Katsuta; Tadahiko Miyoshi, Hitachi; Noboru Baba, Hitachiota; Hiromi Kagohara, Hitachi; Ichiro Inamura, Mobara, all of Japan

[73] Assignee: Hitachi, Ltd., Tokyo, Japan

[21] Appl. No.: 222,615

[22] Filed: Jul. 21, 1988

[30] Foreign Application Priority Data

Jul. 24, 1987 [JP] Japan ..... 62-185267

[51] Int. Cl.[4] ..... H01J 35/10

[52] U.S. Cl. ..... 378/125; 378/127; 378/144

[58] Field of Search ..... 378/125, 127, 143, 144

[56] References Cited

U.S. PATENT DOCUMENTS

| | | | |
|---|---|---|---|
| 4,145,628 | 3/1979 | Iwasaki | 378/125 |
| 4,276,493 | 6/1981 | Srinivasa et al. | 378/125 |
| 4,482,837 | 11/1984 | Koizumi et al. | 378/125 |
| 4,799,250 | 1/1989 | Penato et al. | 378/125 |
| 4,800,581 | 1/1989 | Kujirai et al. | 378/125 |

FOREIGN PATENT DOCUMENTS

| | | |
|---|---|---|
| 55-1014 | 1/1980 | Japan . |
| 55-78449 | 6/1980 | Japan . |
| 57-157447 | 6/1982 | Japan . |
| 58-102449 | 6/1983 | Japan . |
| 59-9841 | 1/1984 | Japan . |
| 59-191247 | 10/1984 | Japan . |
| 60-81745 | 5/1985 | Japan . |

*Primary Examiner*—Carolyn E. Fields
*Assistant Examiner*—David P. Porta
*Attorney, Agent, or Firm*—Antonelli, Terry & Wands

[57] ABSTRACT

A method for generating X-rays in an X-ray tube, comprises the steps of: rotating an X-ray target of a rotating anode, the X-ray target having a metal coated layer thereon; applying electron beams emitted from a cathode onto the metal coated layer of the X-ray target; and offsetting thermal deformation of the X-ray target due to the application of the electron beams by deformation of the X-ray target due to centrifugal force, thereby maintaining a position of the X-ray target in a direction of the application of the electron beams, at a room temperature of the X-ray target, thus generating the X-rays.

31 Claims, 5 Drawing Sheets

X-RAY TUBE AND METHOD FOR GENERATING X-RAYS IN THE X-RAY TUBE

BACKGROUND OF THE INVENTION

The present invention relates to a method for generating X-rays in an X-ray tube used for X-ray computed Tomographs and the like, and to an X-ray tube for performing such method.

In order to reduce the time of diagnosis by means of an X-ray computed Tomograph and to improve a resolving power of an image obtained by an X-ray computed tomograph, it has been desired to have an X-ray target of a rotating anode in an X-ray tube large enough to increase the heat capacity of the X-ray tube. For example, a X-ray target operable at an average temperature of about 1,200° C. has been desired.

In conventional X-ray tubes, there was a problem that, if the X-ray target was large enough to increase the heat capacity thereof, the X-ray target was considerably deformed by heat toward a side opposite to a side of the X-ray target against which electron beams were applied, with the result that an effective amount of X-rays obtained by the X-ray tube was not increased for the increase in heat capacity. Further, if the heat capacity of the X-ray tube is increased, the cooled capacity of the X-ray target must be also increased; to this end, the X-ray target must be rotated at a high speed of the order of about 10,000 r.p.m. In the conventional X-ray target, since the X-ray target has a heavy weight, if it is rotated at high speed, bearings for supporting the X-ray target are subjected to considerable load, which causes the wear of the bearings, resulting in eccentric rotation of the X-ray target. This inconvenience also creates the problem that the effective amount of X-rays obtained by the X-ray tube is not increased for its heat capacity being increased. Further, in this case, there also arises a problem that the withstand voltage of the X-ray tube is reduced due to metal powder from worn bearings.

An X-ray target having a base made of graphite to reduce the weight of the target is already known. However, such X-ray target has been used to be rotated at a speed less than approximately 5,000 r.p.m.; thus, in this conventional light-weight X-ray target, since no consideration has been given to the high speed rotation thereof, if such an X-ray target is rotated at a high speed of approximately 10,000 r.p.m., cracks and the like will be generated; thus, such an X-ray target cannot be used in safety.

SUMMARY OF THE INVENTION

An object of the present invention is to provide a method for generating X-rays in an X-ray tube wherein the heat capacity of an X-ray target of a rotating anode in the X-ray tube can be increased.

Another object of the present invention is to provide an X-ray tube for carrying out the method of the present invention, wherein an effective amount of X-rays can be increased in proportion to the increase of the heat capacity thereof and the withstand voltage of the tube is not reduced.

A further object of the present invention is to provide an X-ray target used as a rotating anode in an X-ray tube, which can increase the heat capacity of the X-ray tube and can be rotated at a high speed in correspondence to the increase of such heat capacity.

A method for generating X-rays in an X-ray tube, according to the present invention, comprises the steps of rotating an X-ray target of a rotating anode, the X-ray target having a metal coated layer thereon; applying electron beams emitted from a cathode onto the metal coated layer of the X-ray target; and offsetting thermal deformation of the X-ray target due to the application of said electron beams by a deformation of the X-ray target due to centrifugal force, thereby maintaining a position of said X-ray target in a direction of the application of the electron beams, thus generating the X-rays, whereby it is possible to increase the heat capacity of the X-ray tube.

An X-ray tube according to one aspect of the present invention comprises a sealed envelope, an X-ray bulb arranged in said sealed envelope, a cathode arranged in said X-ray bulb, an X-ray target arranged in said X-ray bulb, and a rotating mechanism for rotating said X-ray target; the X-ray target having a base and a metal coated layer for generating X-rays when it receives electron beams, the base including an upper surface, a lower surface substantially parallel to said upper surface, a central hole formed in a central portion of the base, an annular inclined surface formed on the upper surface in coaxial with the central hole and inclined toward an outer periphery of the base so as to reduce thickness of the base, and a recess formed in the lower surface in coaxial with the central hole and having depth which makes a ratio of an average thickness of a target portion situated below the annular inclined surface to a thickness of the central hole to a value of 1.2–1.6.

According to another aspect of the present invention, an X-ray tube comprises a sealed envelope, an X-ray bulb arranged in the sealed envelope, a cathode arranged in the X-ray bulb, an X-ray target arranged in the X-ray bulb and a rotating mechanism for rotating the X-ray target; the X-ray target having a base and a metal coated layer for generating X-rays when it receives electron beams; the base including an upper surface, a lower surface substantially parallel to the upper surface, a central hole formed in a central portion of the base, an annular inclined surface formed on the upper surface in coaxial with the central hole and inclined toward an outer periphery of the base so as to reduce a thickness of the X-ray target, and an annular disc fixed to the lower surface in coaxial with the central hole and having a thickness which makes a ratio of an average thickness of a base portion situated between an inner diameter and an outer diameter of the annular inclined surface to a thickness of the central hole to a value of 1.2–1.6.

An X-ray target used as a rotating anode in an X-ray tube, according to one aspect of the present invention, comprises a base and a metal coated layer for generating X-rays when it receives an electron beam, said base including an upper surface, a lower surface substantially parallel to the upper surface, a central hole formed in a central portion of the base, an annular inclined surface formed on the upper surface in coaxial with the central hole and inclined toward an outer periphery of the X-ray target so as to reduce a thickness of the target, and a recess formed in the lower surface in coaxial with the central hole and having depth which makes a ratio of an average thickness of a target portion situated below the annular inclined surface to a thickness of the central hole to a value of 1.2–1.6.

According to another aspect of the present invention, an X-ray target used as a rotating anode, includes a base and a metal coated layer for generating X-rays when it receives electron beams, the base including an upper surface, a lower surface substantially parallel to the upper surface, a central hole formed in a central portion of the base, an annular inclined surface formed on the upper surface in coaxial with the central hole and inclined toward an outer periphery of the X-ray target so as to reduce a thickness of the X-ray target, and an annular disc fixed to the lower surface in coaxial with the central hole and having a thickness which makes a ratio of an average thickness of a target portion situated between an inner diameter and an outer diameter of the annular inclined surface to a thickness of the central hole to a value of 1.2–1.6.

According to a further aspect of the present invention, an X-ray target used as a rotating anode has a configuration that, when X-rays are generated, a distribution of resultant stress comprising a thermal stress and a centrifugal stress along a rotational axis of the X-ray target exists in a range of ±10% of an average value of the resultant stress.

DETAILED DESCRIPTION OF THE PREFERRED EMBODIMENTS

The present invention will now be explained with reference to the attached drawings.

Figure 1:
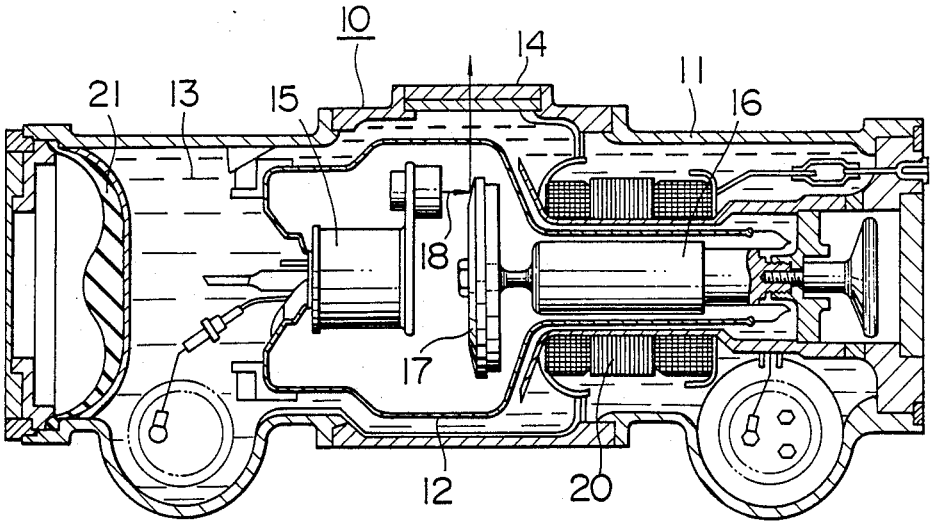
FIG. 1 is a schematic sectional view of an X-ray tube according to the present invention.
Figure 2:
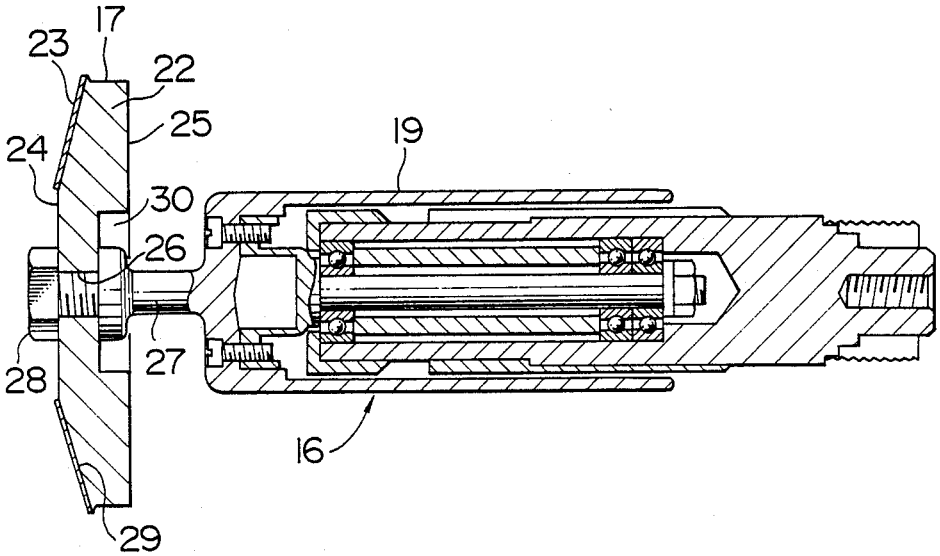
FIG. 2 is a schematic sectional view of a rotating anode used with the X-ray tube of FIG. 1.

As shown in FIGS. 1 and 2, an X-ray tube 10 includes an X-ray bulb 12 arranged in a sealed envelope 11. Around the X-ray bulb 12, the interior of the sealed envelope 11 is filled with cooling medium 13. The sealed envelope 11 has an X-ray emission window 14 formed therein, through which the X-rays are emitted. In the X-ray bulb 12, there are arranged a cathode 15 for emitting an electron beam 18 and a rotating anode 16 onto which the electron beam 18 is applied. The rotating anode 16 has an X-ray target 17 and a rotor 19 for rotating the X-ray target 17. A stator 20 is arranged around the X-ray bulb 12 in a position opposed to the rotor 19. An opening end of the sealed envelope 11 is sealingly closed by a rubber lid 21.

The X-ray target 17 includes a base 22 and a metal coated layer 23 which can emit the X-rays when received the electron beam 18. The base 22 is mainly made of graphite, and the metal coated layer 23 comprises tungsten or rhenium/tungsten alloy. The base 22 includes an upper surface 24, a lower surface 25 substantially parallel to the upper surface, and a central hole 26 into which a rotatable shaft 27 is inserted, the base 22 being fixed to the rotatable shaft 27 by means of an appropriate fastening means such as nut 28. An annular inclined surface 29 is formed on the upper surface 24 of the base in coaxial with the central hole 26. The annular inclined surface is inclined toward an outer periphery of the base 22 so as to reduce a thickness of the base toward the periphery thereof. Preferably, the annular inclined surface is inclined at an angle of 8°–12°. The metal coated layer 23 is deposited on the annular inclined surface 29 by means of chemical vapour deposition process and the like. If the thickness of the coated layer 23 is more than 0.6 mm, number of failure revolutions (of the target) becomes less than 15,000 r.p.m.; thus, in this case, a sufficient safety factor to a practical revolution of 10,000 r.p.m. cannot be ensured. On the other hand, if the thickness of the coating layer 23 is less than 0.2 mm, an excessive heat will be transmitted to the base; thus, in this case, service life of the rotatable shaft 27 is considerably reduced. Accordingly, the thickness of the metal coated layer 23 is preferably in a range of 0.2 mm–0.6 mm.

Next, the method for generating the X-rays according to the present invention will be explained with reference to FIG. 3.

Figure 3:
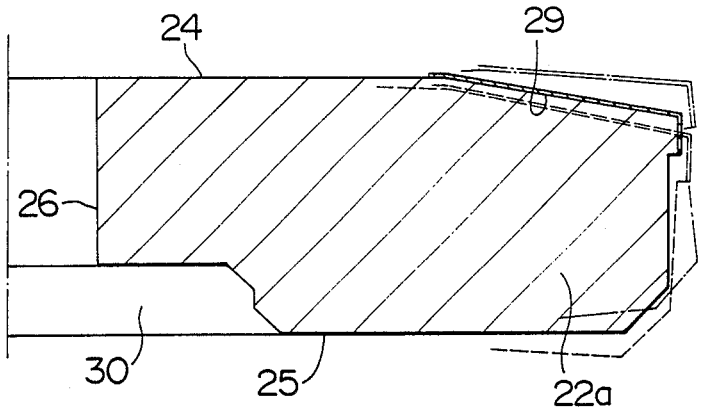
FIG. 3 is a sectional view of a right half of an X-ray target, for explaining a method for generating X-rays according to the present invention.

When the X-ray target 17 is operated at an average temperature of about 1,200° C., as shown by a broken line in FIG. 3, the X-ray target is deformed by heat toward a side (lower side in FIG. 3) opposite to a side (of the target) on which the electron beams 18 are applied. Consequently, the inclination angle of the metal coated layer 23 changes, so that an effective amount of the X-rays emitted from the X-ray emission window 14 is reduced. In the present invention, by positively utilizing a centrifugal force created by the high speed rotation of the target, the X-ray target 17 is deformed toward the side (upper side in FIG. 3) on which the electron beams 18 are applied to cancel or offset the thermal deformation of the X-ray target by the centrifugal deformation thereof, thus maintaining a position of the X-ray target 17 in a direction of the application of the electron beam 18 at a room temperature. In this manner, the metal coated layer 23 is maintained in a proper angular or inclination position, whereby it is possible to increase the effective amount of the X-rays in proportion to the increase of the heat capacity of the X-ray target.

The offsetting of the thermal deformation of the X-ray target by the centrifugal deformation (due to the centrifugal force) thereof may be effected by adjusting the rotational speed of the X-ray target 17. Alternatively, such offsetting may be effected by adjusting an applying condition of the electron beam 18 onto the metal coated layer 23.

Next, the X-ray target for carrying out the above-mentioned method will be explained.

Figure 4:
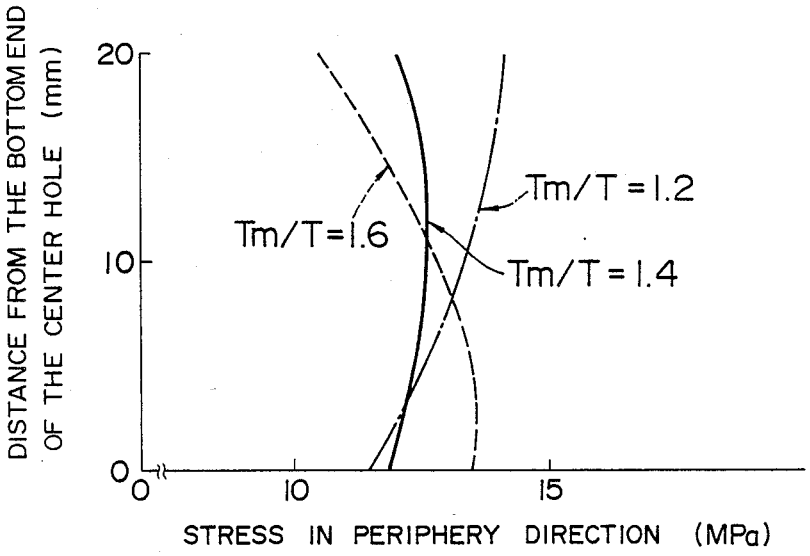
FIG. 4 is a graph showing a relationship between a ratio of a thickness of a central hole of the X-ray target according to the present invention to an average thickness of an annular inclined portion of the target, and a stress distribution along the central hole of the X-ray target.

In order to deform the X-ray target by the centrifugal force toward the side on which the electron beams are applied, a recess 30 is formed in the lower surface 25 of the base 22 in coaxial with the central hole 26. FIG. 4 shows measurement results or data obtained by measuring the distribution of resultant stress consisting of the circumferential thermal stress acting on the base 22 and the centrifugal stress created when the X-ray target 17 is rotated at a speed of 10,000 r.p.m. along the central hole 26 on the basis of a parameter of a ratio Tm/T of the average thickness Tm of a base portion 22*a* situated between an inner diameter and an outer diameter of the annular inclined surface 29 (i.e., a base portion situated under the annular inclined surface 29) to the thickness T of the central hole 26, in order to determine the depth of the recess 30. In FIG. 4, when the ratio Tm/T is 1.2, the relation is shown by an one-dot chain line; when Tm/T is 1.4, the relation is shown by a solid line; and when Tm/T is 1.6, the relation is shown by a broken line. Although it is preferable that the magnitude of the resultant stress is uniformly distributed along the central hole 26, the inventor of the present invention decided that it is permissible to include the distribution of the resultant stress having a value within ±10% of the average value of the resultant stress. As apparent from FIG. 4, when Tm/T is 1.2–1.6, the thickness of the central hole 26 (in other words, the depth of the recess 30) permits the magnitude of the resultant stress along the central hole 26 to enter within the permissible range.

Figure 5:
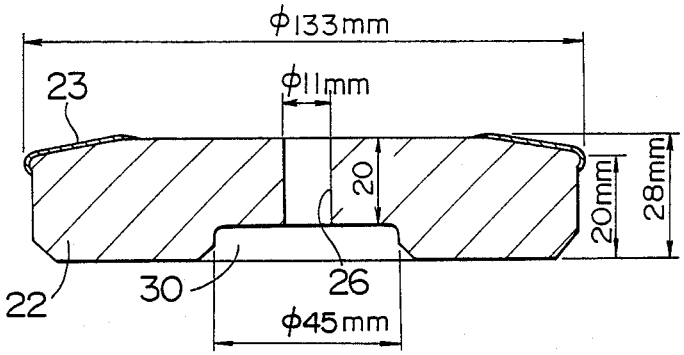
FIG. 5 is a sectional view of an X-ray target according to an embodiment of the present invention.
Figure 6:
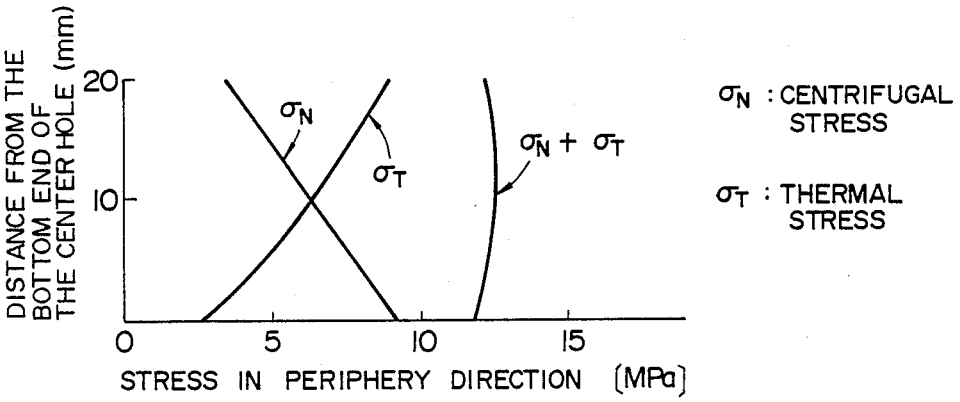
FIG. 6 is a graph showing a stress distribution along a central hole of the X-ray target shown in FIG. 5.

FIG. 5 shows an embodiment of the X-ray target according to the present invention. The base 22 of the target is made of graphite, the depth of the recess 30 is 8 mm, and the ratio Tm/T is 1.2. The distribution of the circumferential resultant stress (of the base 22) along the central hole 26 is shown in FIG. 6. As seen in FIG. 6, the distribution of the resultant stress is in the range of ±10% of the average value of the resultant stress and is uniformly distributed. This means that the base 22 is merely deformed in a radial direction and the inclination of the metal coated layer 23 is maintained to a original position (inclination at a room temperature), thus emitting the X-rays from the X-ray tube effectively.

Figure 7:
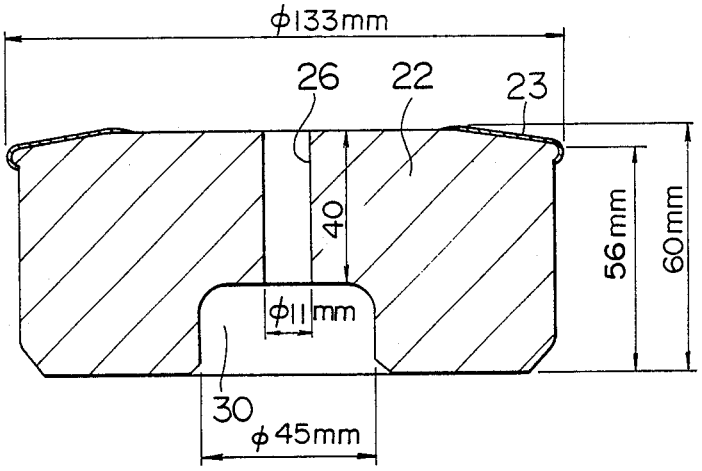
FIG. 7 is a sectional view of an X-ray target according to another embodiment of the present invention.
Figure 8:
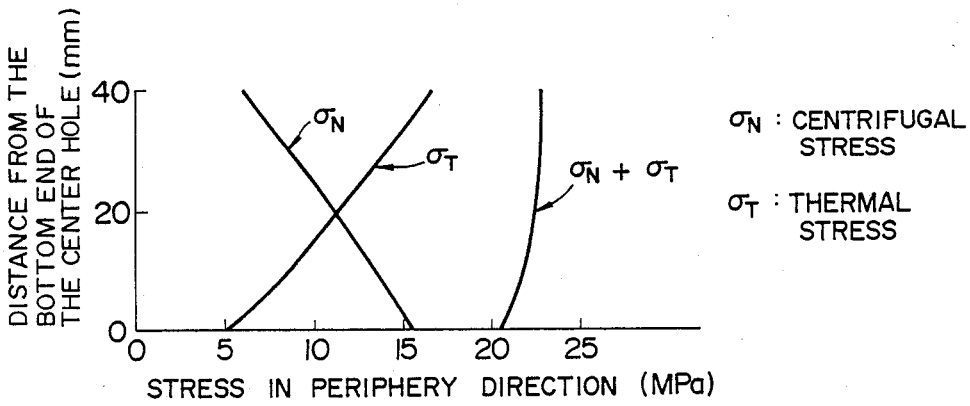
FIG. 8 is a graph showing a stress distribution along a central hole of the X-ray target shown in FIG. 7.

FIG. 7 shows another embodiment of the X-ray target wherein the base 22 is made of graphite, the depth of the recess 30 is 20 mm and the ratio Tm/T is about 1.5. The distribution of the circumferential resultant stress (of the base 22) along the central hole 26 is shown in FIG. 8. As seen in FIG. 8, the distribution of the resultant stress is in the range of ±10% of the average value of the resultant stress, which is intended to by the inventor.

Figure 9:
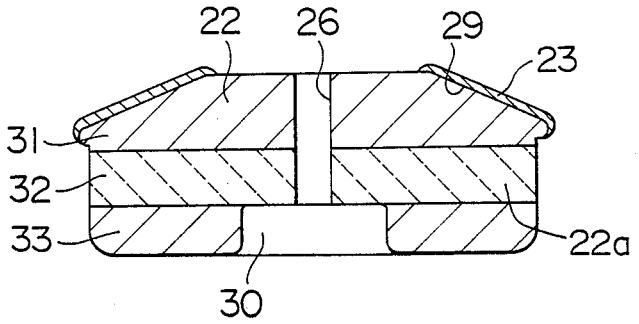
FIG. 9 is a sectional view of an X-ray target according to a further embodiment of the present invention.

FIG. 9 shows a further embodiment of the X-ray target according to the present invention wherein the base 22 comprises an upper layer made of a composite material including ceramics 32 of silicone carbide and graphite 31, and an annular disc 33 of graphite fixed to an undersurface of the upper layer. The annular disc 33 has a thickness so that a ratio Tm/T of the average thickness Tm of a base portion 22*a* situated between an inner diameter and an outer diameter of the annular inclined surface 29 to the thickness T of the central hole 26 is 1.2–1.6. According to this embodiment, since the base is made of the composite material, the strength of this base can be larger than that of the graphite base.

Figure 10:
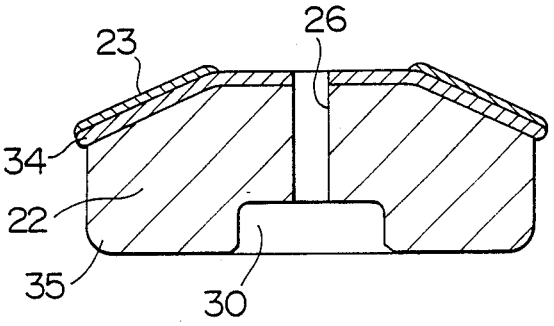
FIG. 10 is a sectional view of an X-ray target according to other embodiment of the present invention.

FIG. 10 shows another embodiment of the X-ray target wherein the base 22 comprises a lower layer 35 made of graphite and an upper thin layer 34 made of molybdenum. According to this embodiment, the weight of the base 22 is slightly increased by the provision of the thin molybdenum layer 34; however, the strength of the base is still larger than that of the graphite base.

What is claimed is:

1. A method for generating X-rays in an X-ray tube, comprising the steps of:

rotating an X-ray target of a rotating anode, said X-ray target having a metal coated layer thereon;

applying electron beams emitted from a cathode onto said metal coated layer of the X-ray target; and offsetting thermal deformation of the X-ray target due to the application of said electron beams by deformation of the X-ray target due to centrifugal force, so as to maintain a position of said X-ray target in a direction of the a of the electron beams, at a predetermined temperature of said X-ray target, thus generating the X-rays.

2. A method as set forth in claim 1, wherein said step of offsetting said thermal deformation of the X-ray target due to the application of the electron beams by said deformation of the X-ray target due to the centrifugal force is effected by adjusting a rotational speed of said X-ray target.

3. A method as set forth in claim 1, wherein said step of offsetting said thermal deformation of the X-ray target due to the application of the electron beams by said deformation of the X-ray target due to the centrifugal force is effected by adjusting an application condition of the electron beams.

4. A method as set forth in claim 1, wherein said step of offsetting said thermal deformation of the X-ray target due to the application of the electron beams by said deformation of the X-ray target due to the centrifugal force is effected by deforming said X-ray target by centrifugal force toward a side of the X-ray target on which said electron beams are applied.

5. An X-ray tube comprising:

a sealed envelope, an X-ray bulb arranged in said sealed envelope, a cathode arranged in said X-ray bulb, an X-ray target arranged in said X-ray bulb, and a rotating mechanism for rotating said X-ray target;

said X-ray target having a base and a metal coated layer for generating X-rays when it receives electron beams, said base including:

an upper surface, a lower surface substantially parallel to said upper surface, a central hole formed in a central portion of said base, an annular inclined surface formed on said upper surface coaxial with said central hole and inclined toward an outer periphery of said X-ray target so as to reduce thickness of said X-ray target, and a recess formed in said lower surface coaxial with said central hole and having depth which makes a ratio of an average thickness of a target portion situated below said annular inclined surface to thickness of said central hole to a value of 1.2–1.6.

6. An X-ray tube as set forth in claim 5, wherein said annular inclined surface is inclined at an angle of 8°–12°.

7. An X-ray tube as set forth in claim 5, wherein said metal coated layer has a thickness of 0.2 mm–0.6 mm.

8. An X-ray tube as set forth in claim 5, wherein said base is made of graphite.

9. An X-ray tube as set forth in claim 5, wherein said base is made of a composite material including ceramics of silicone carbide and graphite.

10. An X-ray tube as set forth in claim 5, wherein said base has two-layer construction, an upper layer of which is made of molybdenum, and a lower layer of which is made of graphite.

11. An X-ray tube comprising:
a sealed envelope,
an X-ray bulb arranged in said sealed envelope,
a cathode arranged in said X-ray bulb,
an X-ray target arranged in said X-ray bulb, and
a rotating mechanism for rotating said X-ray target;
said X-ray target having a base and a metal coated layer for generating X-rays when it receives electron beams;
said base including:
an upper surface,
a lower surface substantially parallel to said upper surface,
a central hole formed in a central portion of said base,
an annular inclined surface formed on said upper surface coaxial with said central hole and inclined toward an outer periphery of said base so as to reduce a thickness of said X-ray target, and
an annular disc fixed to said lower surface coaxial with said central hole and having a thickness which makes a ratio of an average thickness of a base portion situated between an inner diameter and an outer diameter of said annular inclined surface to a thickness of said central hole to a value of 1.2–1.6.

12. An X-ray tube as set forth in claim 11, wherein said annular inclined surface is inclined at an angle of 8°–12°.

13. An X-ray tube as set forth in claim 11, wherein said metal coated layer has a thickness of 0.2 mm–0.6 mm.

14. An X-ray tube as set forth in claim 11, wherein said base is made of graphite.

15. An X-ray tube as set forth in claim 11, wherein said base is made of a composite material including ceramics of silicone carbide and graphite.

16. An X-ray tube as set forth in claim 11, wherein said base has two-layer construction, an upper layer of which is made of molybdenum, and a lower layer of which is made of graphite.

17. An X-ray tube as set forth in claim 11, wherein said annular disc is made of graphite.

18. An X-ray target used as a rotating anode, comprising a base and a metal coated layer for generating X-rays when it receives electron beams, wherein: said base includes
an upper surface,
a lower surface substantially parallel to said upper surface,
a central hole formed in a central portion of said base,
an annular inclined surface formed on said upper surface coaxial with said central hole and inclined toward an outer periphery of said base so as to reduce a thickness of said X-ray target, and
a recess formed in said lower surface coaxial with said central hole and having depth which makes a ratio of an average thickness of a target portion situated below said annular inclined surface to thickness of said central hole to a value of 1.2–1.6.

19. An X-ray target as set forth in claim 18, wherein said annular inclined surface is inclined at an angle of 8°–12°.

20. An X-ray target as set forth in claim 18, wherein said metal coated layer has a thickness of 0.2 mm–0.6 mm.

21. An X-ray target as set forth in claim 18, wherein said base is made of graphite.

22. An X-ray target as set forth in claim 18, wherein said base is made of a composite material including ceramics of silicone carbide and graphite.

23. An X-ray target as set forth in claim 18, wherein said base has two-layer construction, an upper layer of which is made of molybdenum, and a lower layer of which is made of graphite.

24. An X-ray target used s a rotating anode, comprising a base and a metal coated layer for generating X-rays when it receives electron beams, wherein: said base includes
an upper surface,
a lower surface substantially parallel to said upper surface,
a central hole formed in a central portion of said base,
an annular inclined surface formed on said upper surface coaxial with said central hole and inclined toward an outer periphery of said base so as to reduce a thickness of said X-ray target, and
an annular disc fixed to said lower surface coaxial with said central hole and having thickness which makes a ratio of an average thickness of a base portion situated between an inner diameter and an outer diameter of said annular inclined surface to thickness of said central hole to a value of 1.2–1.6.

25. An X-ray target as set forth in claim 24, wherein said annular inclined surface is inclined at an angle of 8°–12°.

26. An X-ray target as set forth in claim 24, wherein said metal coated layer has a thickness of 0.2 mm–0.6 mm.

27. An X-ray target as set forth in claim 24, wherein said base is made of graphite.

28. An X-ray target as set forth in claim 24, wherein said base is made of a composite material including ceramics of silicone carbide and graphite.

29. An X-ray target as set forth in claim 24, wherein said base has two-layer construction, an upper layer of which is made of molybdenum, and a lower layer of which is made of graphite.

30. An X-ray target as set forth in claim 24, wherein said annular disc is made of graphite.

31. An X-ray target used as a rotating anode comprising:
means for distributing thermal stress along a rotational axis of said X-ray target; and
means for distributing centrifugal stress along a rotational axis of said X-ray target;
said means for distributing thermal stress and said means for distributing centrifugal stress enabling a distribution of a resultant stress comprised of said thermal stress and said centrifugal stress in a range of ±10% of an average value of said resultant stress.

* * * * *

UNITED STATES PATENT AND TRADEMARK OFFICE

CERTIFICATE OF CORRECTION

PATENT NO. : 4,891,831

DATED : January 2, 1990

INVENTOR(S) : A. TANAKA, et al.

It is certified that error appears in the above-identified patent and that said Letters Patent is hereby corrected as shown below:

Title page:

In line [73] insert the following additional assignee:

-- and Hitachi Medical Corporation --

Signed and Sealed this

Twenty-eighth Day of May, 1991

*Attest:*

HARRY F. MANBECK, JR.

*Attesting Officer*

*Commissioner of Patents and Trademarks*